US007525550B2

(12) United States Patent
Shioda et al.

(10) Patent No.: US 7,525,550 B2
(45) Date of Patent: Apr. 28, 2009

(54) CONTROLLER DRIVER, MOBILE TERMINAL USING THE SAME, AND DISPLAY PANEL DRIVING METHOD

(75) Inventors: Junyou Shioda, Kanagawa (JP); Hirobumi Furihata, Kanagawa (JP)

(73) Assignee: NEC Electronics Corporation, Kawasaki, Kanagawa (JP)

( * ) Notice: Subject to any disclaimer, the term of this patent is extended or adjusted under 35 U.S.C. 154(b) by 667 days.

(21) Appl. No.: 11/049,999

(22) Filed: Feb. 4, 2005

(65) Prior Publication Data

US 2005/0231528 A1 Oct. 20, 2005

(30) Foreign Application Priority Data

Feb. 6, 2004 (JP) ..... 2004-030801

(51) Int. Cl.
*G09G 5/00* (2006.01)
*G09G 5/36* (2006.01)

(52) U.S. Cl. ..... 345/545; 345/536; 345/537; 345/569; 345/581; 345/589; 345/475; 345/522

(58) Field of Classification Search ..... 345/537, 345/545, 536, 569, 581, 589, 522, 475
See application file for complete search history.

(56) References Cited

U.S. PATENT DOCUMENTS 4,635,048 A 1/1987 Nishi et al.
5,200,739 A 4/1993 Eland
5,751,930 A 5/1998 Katsura et al.
5,793,351 A 8/1998 Leach
5,876,286 A * 3/1999 Lee ..... 463/31
5,920,355 A * 7/1999 Kim ..... 348/569
6,181,353 B1 * 1/2001 Kurisu ..... 345/537
6,351,291 B1 * 2/2002 Asano ..... 348/564
6,462,746 B1 * 10/2002 Min et al. ..... 345/545
6,624,815 B1 9/2003 Morrish (Continued)

FOREIGN PATENT DOCUMENTS

JP 2000-530898 2/2001

OTHER PUBLICATIONS

European Search Report dated Jul. 28, 2006.

*Primary Examiner*—Jin-Cheng Wang
(74) *Attorney, Agent, or Firm*—McGinn IP Law Group, PLLC

(57) ABSTRACT

A controller driver includes a color palette circuit configured to hold color palette data indicating a relation of a color reference numbers corresponding to a color and RGB data corresponding to the color, a first memory section configured to hold first layer data containing first RGB data specifying a color of each of pixels of a first layer image; a second memory section configured to hold second layer data containing a color reference number specifying a color of each of pixels of a second layer image; a calculating circuit configured to generate synthetic image data of the first layer data and the second layer data; and a driving circuit configured to drive a display panel based on the synthetic image data. The calculating circuit converts each of the color reference numbers of the second layer data into second RGB data by using the color palette data, and generates synthetic RGB data from the first RGB data and the second RGB data, the synthetic RGB data specifying a color of each of pixels of the synthetic image data.

20 Claims, 12 Drawing Sheets

U.S. PATENT DOCUMENTS 7,139,014 B1 * 11/2006 Kim et al. ..... 348/14.01
7,212,250 B1 * 5/2007 Neal ..... 348/569
2002/0039105 A1 * 4/2002 Park ..... 345/603
2002/0171765 A1 * 11/2002 Waki et al. ..... 348/589
2003/0103143 A1 * 6/2003 Fujimori et al. ..... 348/173
2003/0169268 A1 9/2003 Tang et al.
2003/0222999 A1 12/2003 Sasaki
2004/0012606 A1 * 1/2004 Gim ..... 345/589

* cited by examiner

Fig. 2

6

| COLOR REFERENCE NO. | COLOR |
|---|---|
| 0 | TRANSPARENT |
| 1 | BLUE |
| 2 | RED |
| 3 | YELLOW |

RGB DATA FROM COLOR PALETTE CIRCUIT 23
XXX
BLUE
YELLOW
RED
XXX
BLUE
YELLOW

COLOR REFERENCE NO. FROM COLOR PALETTE CIRCUIT 23
0
1
2
3
0
1
2

RGB DATA OF 1ST LAYER DATA 5A
A
B

COLOR REFERENCE NO. OF 2ND LAYER DATA 5B
1
0

WRITE SIGNAL 28

SYNTHETIC RGB DATA 30A
BLUE
B
1ST CYCLE
2ND CYCLE

CONTROLLER DRIVER, MOBILE TERMINAL USING THE SAME, AND DISPLAY PANEL DRIVING METHOD

BACKGROUND OF THE INVENTION

1. Field of the Invention

The present invention relates to a controller driver, a mobile terminal using the same, and a display panel driving method.

2. Description of the Related Art

In general, a display panel such as a liquid crystal display (LCD) panel is driven by a controller driver. The controller driver is sometimes provided separately from the display panel, and the controller driver is sometimes provided with the display panel by using the COG (chip on glass) technique. The controller driver receives display data to be displayed, and stores the received display data in a display memory. Based on the display data stored in the display memory, the controller driver drives data lines of the display panel to display an image.

The image displayed on the display panel is often generated by synthesizing a plurality of images. The synthesis of the images is exemplified by an OSD (on-screen display) process in which a character image is superimposed on a background image, and a $\alpha$ blending process in which colors of pixels are blended between a plurality of images. By synthesizing the plurality of images, a variety of the images can be displayed on the display panel.

Japanese Laid Open Patent Application (JP-P2000-530898A) discloses a projection type display apparatus, in which a decoration effect image and an original image are synthesized. The conventional projection type display apparatus includes a frame memory for storing bit map data of the original image, a decoration effect bit map memory for storing bit map data of the decoration effect image, a decoration effect superimposing circuit, a liquid crystal display drive circuit and a liquid crystal panel. The decoration effect superimposing circuit generates a superimposed image data, in which the original image and the decoration effect image are superimposed, and supplies it to the liquid crystal display drive circuit (the controller driver). The liquid crystal display drive circuit drives the liquid crystal panel based on the superimposed image data.

In a display apparatus installed in a mobile terminal, a necessary space for the display apparatus must be reduced. Therefore, it is preferable to provide the function of synthesizing a plurality of images to the control driver of the mobile terminal, from the viewpoints of distribution of calculation processes and easy installation of the controller driver in the mobile terminal, unlike the above-mentioned projection type display device.

It is necessary to provide a memory with a capacity enough for storing each image for the controller driver, in order to give the controller driver the function of synthesizing the plurality of images. However, it is undesirable to install a large capacity of memory in the controller driver since this increases a cost. Especially, in the controller drivers in the mobile terminal such as a cellular phone and PDA (personal digital assistant), it is undesirable since the installation of a large capacity of memory results in the increase in power consumption and the spatial data size.

In this way, it is demanded to provide the controller driver having the function of calculating a plurality of images with smaller capacity of memory.

SUMMARY OF THE INVENTION

In an aspect of the present invention, a controller driver includes a color palette circuit configured to hold color palette data indicating a relation of a color reference numbers corresponding to a color and RGB data corresponding to the color, a first memory section configured to hold first layer data containing first RGB data specifying a color of each of pixels of a first layer image; a second memory section configured to hold second layer data containing a color reference number specifying a color of each of pixels of a second layer image; a calculating circuit configured to generate synthetic image data of the first layer data and the second layer data; and a driving circuit configured to drive a display panel based on the synthetic image data. The calculating circuit converts each of the color reference numbers of the second layer data into second RGB data by using the color palette data, and generates synthetic RGB data from the first RGB data and the second RGB data, the synthetic RGB data specifying a color of each of pixels of the synthetic image data.

Here, the color palette data contains a transparent color reference number corresponding to a transparent color. When the color reference number of a specific one of the pixels of the second layer image is the transparent color reference number, the calculating circuit may output the first RGB data corresponding to the specific pixel as the synthetic RGB data corresponding to the specific pixel. In this case, in the controller driver, a control circuit may receive the color palette data from outside and write into the color palette circuit.

Also, in the controller driver, a control circuit may receive the second layer data from outside and write into the second memory section.

Also, in the controller driver, a control circuit may receive RGB image data composed of third RGB data to specify the color of each of the pixels of the second layer image, convert the RGB image data into the second layer data, and write the second layer data in the second memory section.

Also, the color palette circuit may output a set of the RGB data and the color reference number to the calculating circuit for every the color reference number. When the color reference number contained in the second layer data is coincident with the color reference number received from the color palette circuit, the calculating circuit determines the synthetic RGB data corresponding to the color reference number received from the color palette circuit as the second RGB data.

Also, when the second layer image is a character image for characters, a font drawing circuit of the controller driver may receive font data supplied from outside and showing a shape and a color of each of the characters, and generate the second layer data from the font data. In this case, a font process memory section may be used as a work area when the font drawing circuit generates the second layer data. The font drawing circuit generates the second layer data in the font process memory section from the font data, and the second layer data is transferred to the second memory section from the font process memory section. Also, the font drawing circuit may divide the character image into rectangular areas and generates rectangular area data specifying a color of pixels in the rectangle area by a color reference number. The font process memory section may be configured such that pixel data specifying the color of the pixels of a plurality of rows and columns in the rectangle area can be written at a time based on the rectangle area data.

In another aspect of the present invention, a mobile terminal includes a display panel; the above-mentioned controller driver; and a processing unit configured to supply to the controller driver, first layer data composed of first RGB data to specify each of colors of a first layer image and second layer data composed of a color reference number to specify each of colors of a second layer image.

In still another aspect of the present invention, a display panel driving method is achieved by providing for a controller driver, color palette data indicating a relation of color reference numbers corresponding to colors and RGB data corresponding to the colors; by holding in the controller driver, first layer data composed of first RGB data specifying a color of each of pixels of a first layer image; by holding in the controller driver, second layer data composed of a color reference number specifying a color of each of pixels of a second layer image; by synthesizing the first layer data and the second layer data by a calculating circuit to generate synthetic image data; and by driving a display panel based on the synthetic image data by the controller driver. The synthesizing may be preferably achieved by converting the color reference numbers for each of the pixels of the second layer image into second RGB data by using the color palette data; and by generating RGB data of the synthetic image data by using the first RGB data and the second RGB data.

BRIEF DESCRIPTION OF THE DRAWINGS

FIG. 2 is a diagram showing color palette data;

DESCRIPTION OF THE PREFERRED EMBODIMENTS

Hereinafter, a mobile terminal using a controller driver for driving a display panel and a display panel driving method of the present invention will be described in detail with reference to the attached drawings.

First Embodiment

Figure 1:
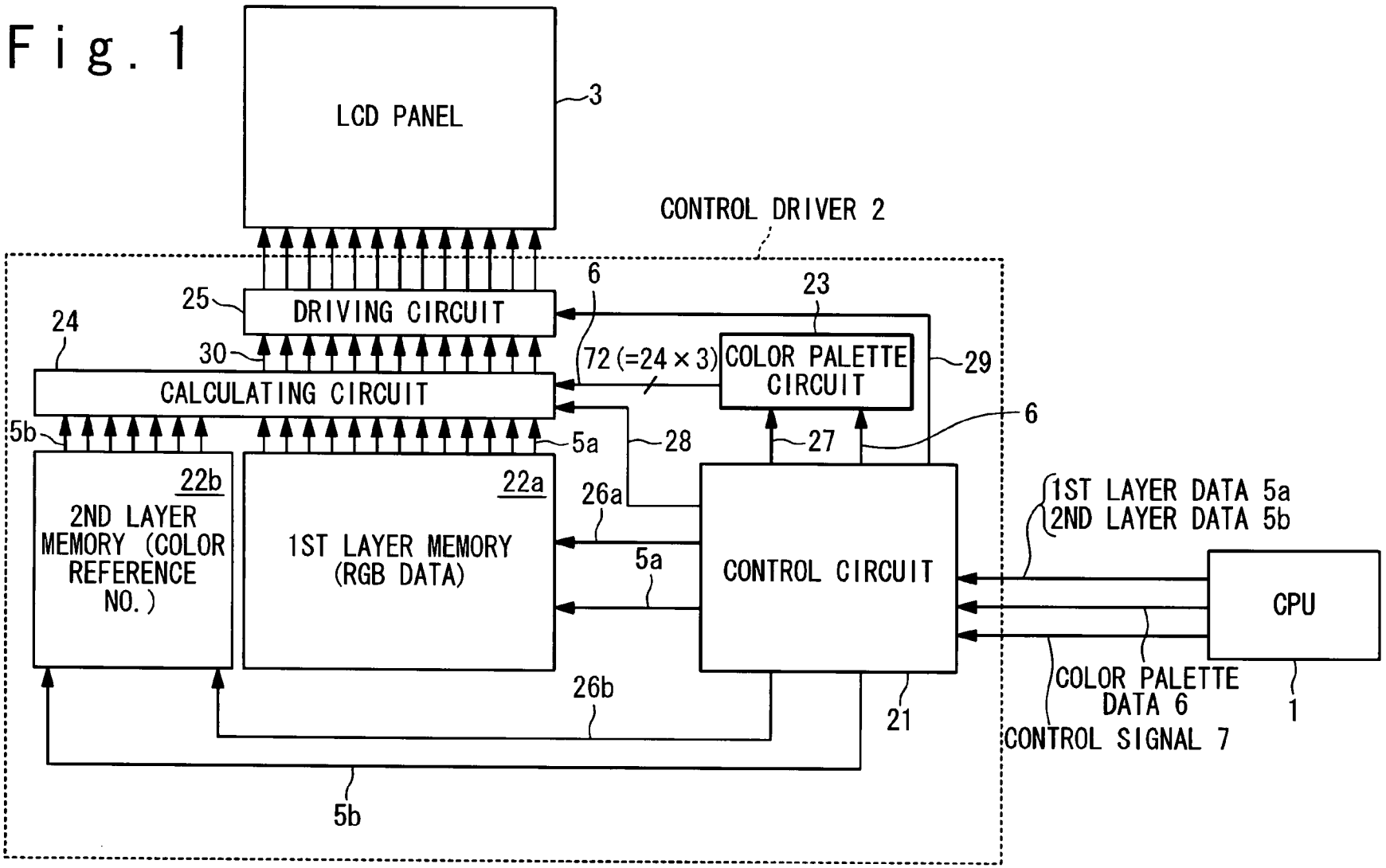
FIG. 1 is a block diagram showing the circuit configuration of a controller driver of a mobile terminal having a controller driver according to a first embodiment of the present invention.

FIG. 1 is a block diagram showing the circuit configuration of a mobile terminal having a controller driver according to the first embodiment of the present invention. The mobile terminal includes a CPU 1, a controller driver 2, and a LCD panel 3 in which pixels are arranged in a matrix. The CPU 1 supplies to the controller driver 2, display data for an image to be displayed on the LCD panel 3, a color palette data 6, and a control signal 7. The controller driver 2 drives the LCD panel 3 based on the display data and the color palette data 6 in response to the control signal 7.

The display data supplied from the CPU 1 to the controller driver 2 includes two kinds of data; one kind of data is first layer data 5*a* for a first layer image, and the other kind of data is second layer data 5*b* for a second layer image to be synthesized with or superimposed on the first layer image. The first layer image is an image represented in many colors, typically a photography image. The second layer image is an image represented in small number of colors, typically a character image and a draw graphic image. A synthetic image is generated by synthesizing the first layer image and the second layer image and is displayed on the LCD panel 3. The synthesis is exemplified by an OSD process and an $\alpha$ blending process. In the OSD process, a part of the first layer image is overwritten with the second layer image, and in the $\alpha$ blending, the first layer image and the second layer image are blended.

The first layer data 5*a* has a normal bit map image format. That is, the first layer data 5*a* is composed of RGB data, in which a color of each of pixels of the first layer image is expressed in a gradation level of each of R, G, and B colors. 8 bits are assigned to the gradation level of each of the R, G, and B colors in each pixel of the first layer data 5*a* in the first embodiment. Therefore, the color of each pixel in the first layer image is expressed by 24 bits, and as the result of this, the first layer image can express $2^{24}$, or 16,700,000 colors.

On the other hand, the second layer data 5*b* is composed of pixel data that a color of each of pixels of the second layer image is specified by a color reference number. The number of bits necessary to specify the color of each pixel of the second layer image is determined based on the number of colors used in the second layer image. The number of colors usable in the second layer image is $2^n$ when the color of each pixel of the second layer image is specified with the color reference number of n bits. The number of colors usable in the second layer image is preferably selected to be fewer than the number of colors usable in the first layer image. Therefore, the data quantity of the second layer data 5*b* for the second layer image of one frame is smaller than that of the first layer data 5*a* for the first layer image of one frame. In the first embodiment, the color reference number is expressed by 2 bits. Therefore, the number of kinds of the color reference number is 4 from 0 to 3.

The color palette data 6 indicates a relation of the color reference number and RGB data for a color specified based on the color reference number. FIG. 2 shows the color palette data 6 conceptually. For instance, the color reference number "1" denotes "Blue" (of RGB data), the color reference number "2" denotes "Red" (of RGB data), and the color reference number "3" denotes "Yellow" (of RGB data).

The color reference number "0" has a special meaning, and shows a "Transparency". The "transparency" pixel is important when the synthetic image is generated by synthesizing the first layer image and the second layer image. In the synthesizing operation of the "transparency" pixel of the second layer image and a pixel of the first layer image, the color of a pixel of the synthetic image corresponding to these pixels is determined to be the color of the pixel of the first layer image. That is, the "transparency" pixel does not affect the synthetic image, and therefore the pixel is described as "transparency". The use of the color reference number indicative of the "transparency" is preferable in improvement of degree of freedom in the image operation. The color reference number "0" does not specify any RGB data, and instead, the pixel with the color reference number "0" is subjected to a special process as mentioned later.

Careful attention should be paid in that the second layer image can express colors of the same number as the number of colors of the first layer image by changing the color palette data 6 properly. For instance, when the color of each pixel of the first layer image is represented in 24 bits, the number of colors usable in the first layer image $2^{24}$, or 16,700,000 colors. On the other hand, the number of colors usable in the second layer image described in the color reference number of n bits is only $(2^n-1)$ colors selected from the 16,700,000 colors at a same time, excluding the "Transparency". However, it should be noted that the 16,700,000 colors can be used in the second layer image by changing the content of the color palette data 6. This is preferable in improvement of degree of freedom of colors in the second layer image.

The controller driver 2 includes a control circuit 21, a first layer memory 22*a*, a second layer memory 22*b*, a color palette circuit 23, a calculating circuit 24, and a driving circuit 25.

The control circuit 21 controls each circuit section of the controller driver 2 in response to the control signal 7 sent from the CPU 1. Specifically, the control circuit 21 writes the first layer data 5*a* and the second layer data 5*b* sent from the CPU 1 into the first layer memory 2 and the second layer memory 22*b*, respectively. Also, the control circuit 21 writes the color palette data 6 sent from the CPU 1 into the color palette circuit 23. Further, the control circuit 21 supplies a first layer memory control signal 26*a*, a second layer memory control signal 26*b*, a color palette control signal 27, a write signal 28, and a timing control signal 29 to the first layer memory 22*a*, the second layer memory 22*b*, the color palette circuit 23, the calculating circuit 24, and the driving circuit 25, respectively, in order to control the respective circuits.

The first layer memory 22*a* and the second layer memory 22*b* receive the first layer data 5*a* and the second layer data 5*b* from the control circuit 21, respectively. The second layer data 5*b*, in which the color is described in the color reference number, is stored in the second layer memory 22*b*. Therefore, the capacity of the second layer memory 22*b* may be small. In this case, the memory capacity necessary for the controller driver 2 to synthesize a plurality of images can be reduced.

The color palette circuit 23 receives the color palette data 6. The color palette circuit 23 outputs the stored color palette data 6 to the calculating circuit 24.

The calculating circuit 24 reads out the first layer data 5*a* from the first layer memory 22*a*, and the second layer data 5*b* from the second layer memory 22*b*, and then carries out a calculation to synthesize the first layer data 5*a* and the second layer data 5*b*. As the result of the calculation, a synthetic image bit map data 30 is generated as the synthetic image of the first layer image and the second layer image. In the calculation to synthesize the first layer data 5*a* and the second layer data 5*b*, it is needed that the color reference number, which specifies the color of each pixel of the second layer data 5*b*, is converted into RGB data. Therefore, the calculating circuit 24 converts the color reference number described in the second layer data 5*b* into RGB data by using the color palette data 6. The RGB data generated through the conversion is used for calculation to synthesize the first layer data 5*a* and the second layer data 5*b*.

The driving circuit 25 drives the LCD panel 3 based on the synthetic image bit map data 30 received from the calculating circuit 24. As a result, the synthetic image, in which the first layer image is synthesized with or superimposed on the second layer image, is displayed on the LCD panel 3.

Figure 3:
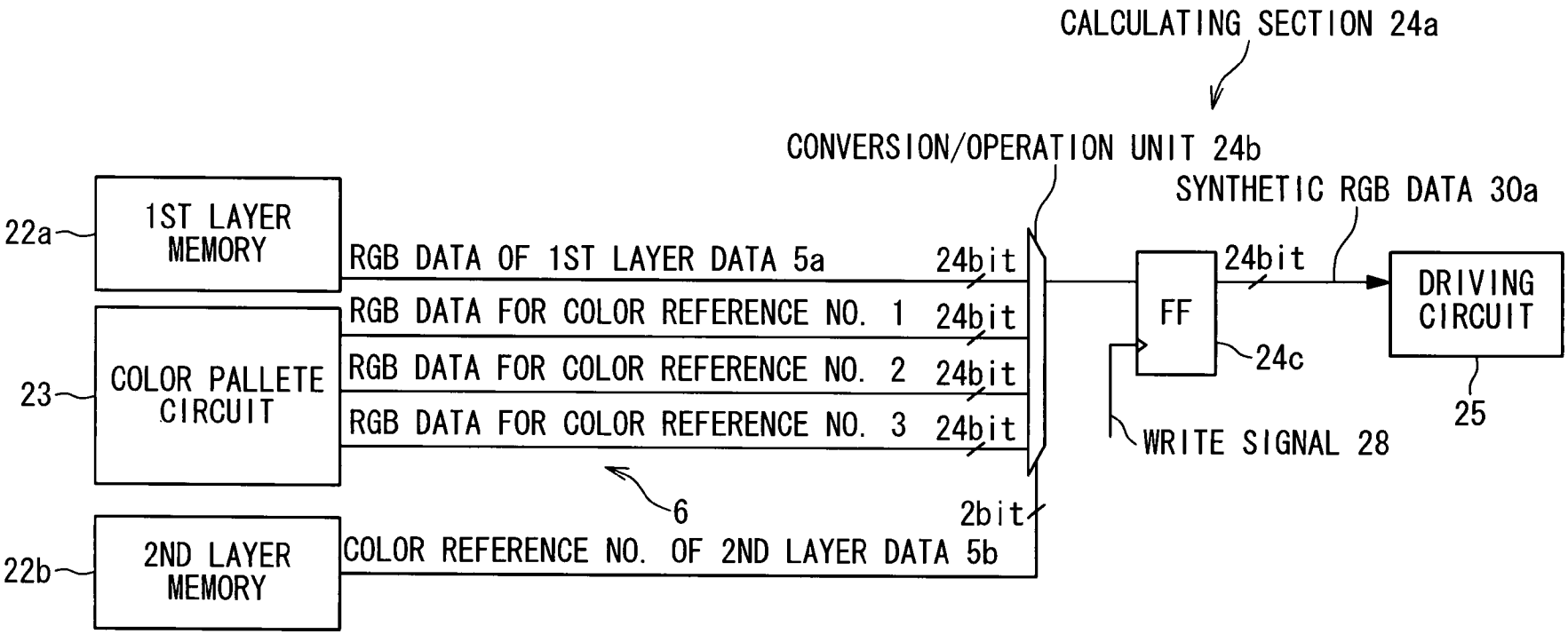
FIG. 3 is a block diagram showing the circuit configuration of a calculating section of a calculating circuit in the first embodiment of the present invention.

As shown in FIG. 3, the calculating circuit 24 contains a calculating section 24*a*. The calculating section 24*a* includes a conversion/operation unit 24*b* and a flip-flop 24*c*. The conversion/operation unit 24*b* carries out an operation to the RGB data of each pixel of the first layer data 5*a* and the color reference number of a corresponding pixel of the second layer data 5*b*. The flip-flop 24*c* latches the operation result by the conversion/operation unit 24*b* in response to the write signal 28 sent from the control circuit 21, and outputs the latched result to the driving circuit 25 as the synthetic RGB data 30*a*. A set of the synthetic RGB data 30*a* outputted from the flip-flops 24*c* of the calculating section 24 is the synthetic image bit map data 30, which is outputted from the calculating circuit 24 to the driving circuit 25. The calculating circuit 24 shown in FIG. 3 includes the calculating sections 24*a* and the flip-flops 24*c* of the same number as the number of pixels for one line on the LCD panel 3.

An operation of the conversion/operation unit 24*b* will be described in detail below. The conversion/operation unit 24*b* reads out the RGB data of the pixels of the first layer data 5*a* from the first layer memory 22*a*, and reads out the color reference numbers of the pixels of the second layer data 5*b* from the second layer memory 22*b*. In addition, the conversion/operation unit 24*b* reads out the color palette data 6 from the color palette circuit 23. As mentioned above, the color palette data 6 is composed of the RGB data corresponding to each color reference number. The color palette data 6 is sent to the conversion/operation unit 24*b* in parallel. That is, all the RGB data of the color palette data 6 are sent to the conversion/operation unit 24*b* at a time.

The conversion/operation unit 24*b* selects the RGB data corresponding to the received color reference number of each pixel from among the color palette data 6 sent from the color palette circuit 23. In addition, the conversion/operation unit 24*b* carries out the calculation to the selected RGB data and the RGB data of the first layer data 5*b* to generate the synthetic RGB data 30*a*. Here, it should be noted that the processes of selecting the RGB data corresponding to the color reference number and calculating using the selected RGB data are equivalent to a process of converting the color reference number into the synthetic RGB data. When the color reference number of the second layer data 5*b* is "0", the above-mentioned special operation is carried out as follows.

When the color reference number of the second layer data 5*b* is "0", that is, when the color of the pixel of the second layer data 5*b* indicates "transparency", the conversion/operation unit 24*b* outputs the RGB data of the first layer data 5*b* as the synthetic RGB data 30*a* as it is. As a result, it is reflected to the calculation that the color of the pixel of the second layer data 5*b* indicates "transparency".

Figure 4:
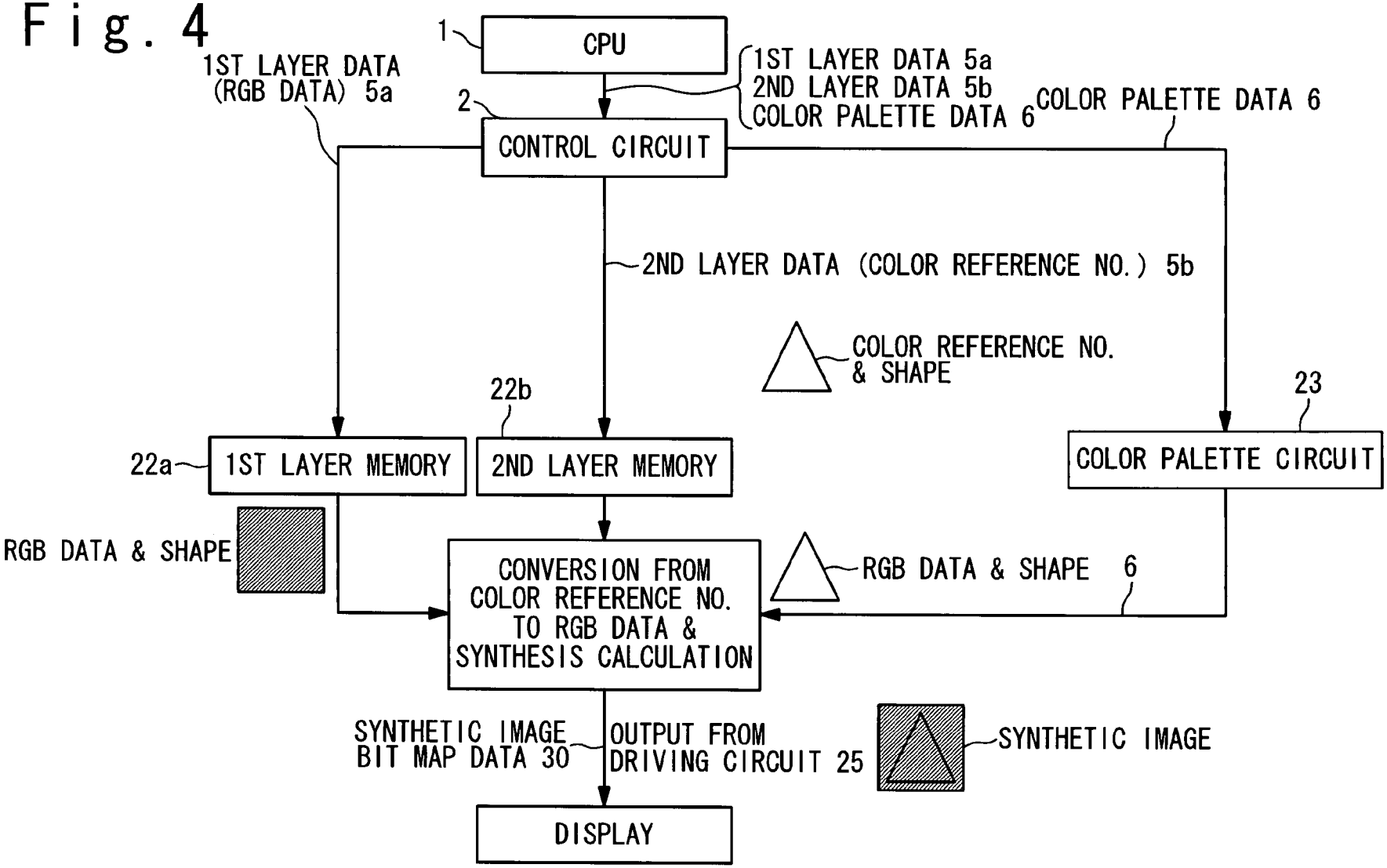
FIG. 4 is a block diagram showing an operation of the controller driver in the first embodiment.

FIG. 4 is a block diagram showing an operation of the controller driver 2 in the first embodiment. First, the first layer data 5*a* is supplied from the CPU 1 to the controller driver 2. As mentioned above, the first layer data 5*a* is composed of the RGB data specifying the colors of the pixels of the first layer image. The first layer data 5*a* is stored in the first layer memory 22*a*.

Subsequently, the color palette data 6 is supplied from the CPU 1 to the controller driver 2. The color palette data 6 is stored in the color palette circuit 23.

Further, the second layer data 5*b* is supplied from the CPU 1 to the controller driver 2. As mentioned above, the second layer data 5*b* is composed of the color reference numbers specifying the colors of the pixels of the second layer image. The second layer data 5*b* is stored in the second layer memory 22*b*.

The calculating circuit 24 reads out the first layer data 5*a* and the second layer data 5*b* from the first layer memory 22*a* and the second layer memory 22*b*, respectively. Then, the calculating circuit 24 converts each color reference number in the second layer data 5*b* into the RGB data for the pixel. The calculating circuit 24 carries out the synthesis calculation of the RGB data generated through the conversion and the RGB data of the first layer data 5*a*. As a result, the synthetic image bit map data 30 is generated.

The driving circuit 25 drives the LCD panel 3 based on the synthetic image bit map data 30. As a result, the synthetic image, in which the first layer image and the second layer image are synthesized, is displayed on the LCD panel 3.

In the first embodiment as described above, the second layer data 5*b* stored in the second layer memory 22*b* is described in the format of the color reference number. Therefore, the capacity of the second layer memory 22*b* can be decreased. As a result, the controller driver 2 is realized which the calculation to the plurality of images can be carried out while the capacity of the installed memory is reduced. The reduction in the capacity of the installed memory is effective for reduction of a spatial size of the controller driver 2.

Also, it is effective in the reduction of the power consumption in the controller driver 2 to describe the second layer data 5*b* in the color reference numbers. The controller driver 2 consumes some power whenever it receives the data bits of display data. Therefore, the reduction of the data quantity of the display data is effective to reduce the power consumption by the controller driver 2. Describing the second layer data 5*b* in the format of the color reference number contributes to the reduction of the data quantity of the display data sent from the CPU 1 to the controller driver 2, resulting in effective reduction of the power consumption by the controller driver 2. It is essentially important that the power consumption of the controller driver 2 is small, when the controller driver 2 is installed in a mobile terminal.

The use of the reference color numbers for the second layer image decreases the number of directly usable colors, but it is not a serious problem in a practical use. This is because the second layer image needs not to be expressed in many colors in many cases. Especially, it is true in case that the second layer image to be synthesized with the first layer image is a character image or a draw graphic image.

In the first embodiment, the color palette data 6 may be stored in the color palette circuit 23 without update. In this case, the color palette data 6 is not necessarily supplied from the CPU 1 to the controller driver 2. However, the configuration in which the color palette data 6 can be supplied from the CPU 1 to the controller driver 2 is preferable to describe a variety of the second layer images.

Figure 5:
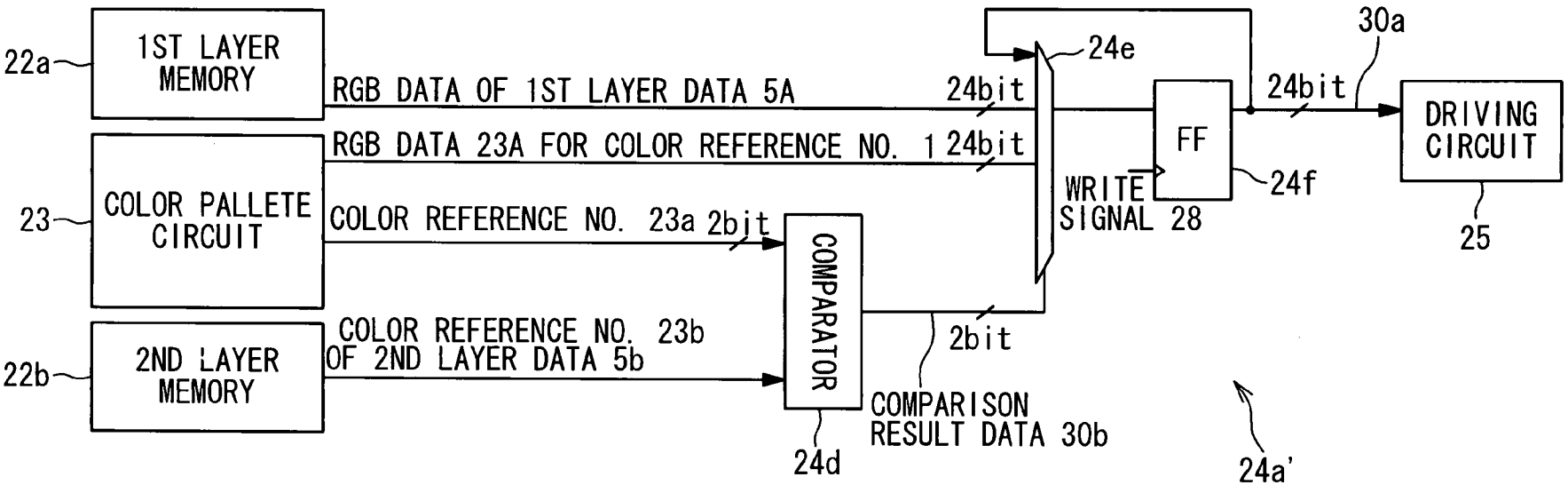
FIG. 5 is a block diagram showing another circuit configuration of the calculating section of the calculating circuit in the first embodiment of the present invention.
Figures 6A, 6B, 6C, 6D, 6E, 6F:
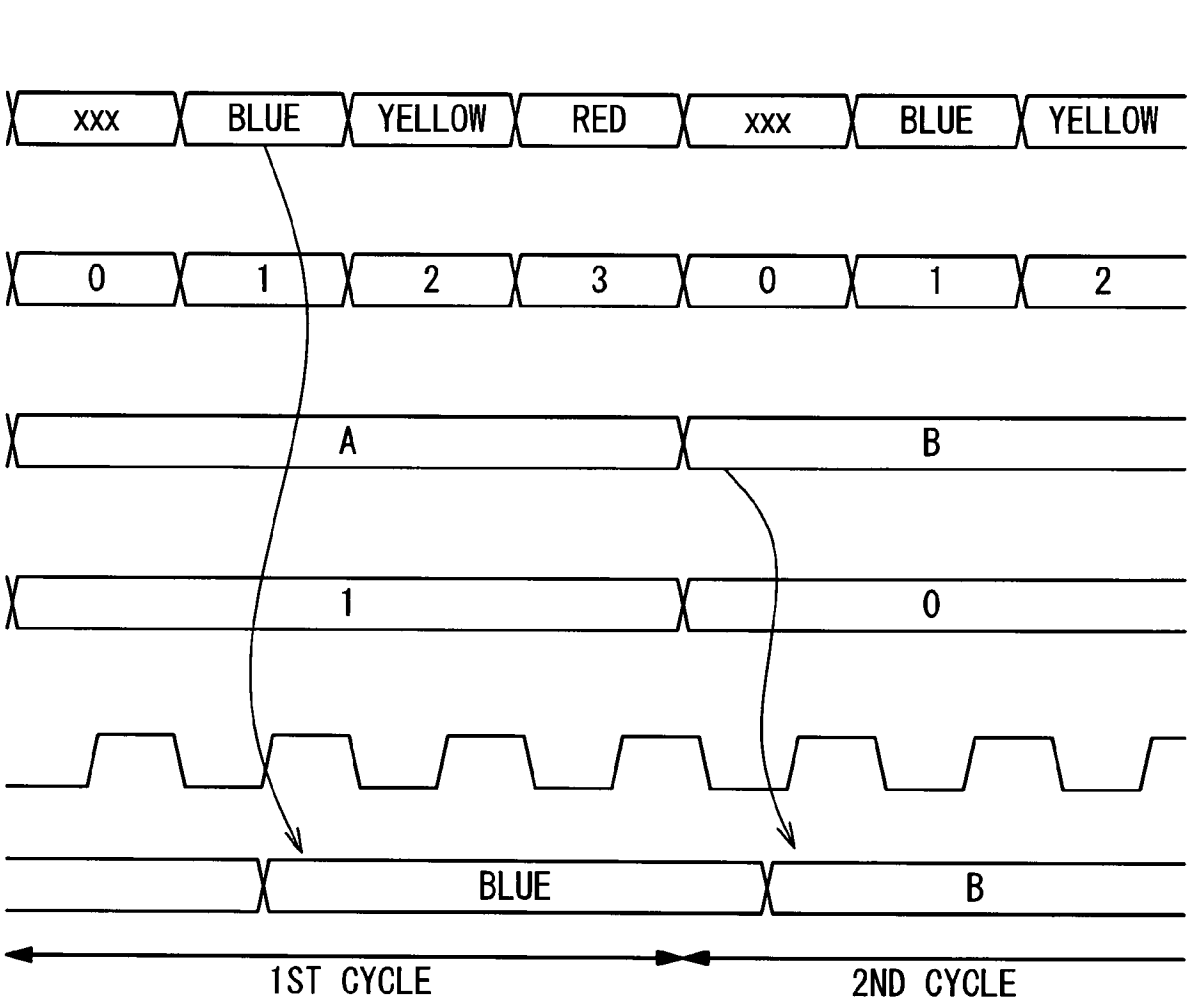
FIGS. 6A to 6F are timing charts showing a generation process of synthetic RGB data from the calculating circuit shown in FIG. 5.

In the first embodiment, the RGB data corresponding to all of the color reference numbers are sent in parallel to the calculating section 24*a* shown in FIG. 3. Therefore, the number of wirings to send the RGB data might increase. To solve this problem, a calculating section 24*a*' shown in FIG. 5 can be used in place of the calculating section 24*a* shown in FIG. 3. In this case, the color palette circuit 23 sequentially sends the RGB data of the color palette data 6 for all the kinds of color reference numbers. At the same time, the color reference number is sent to the calculating section 24*a*'. In FIG. 5, the RGB data sent from the color palette circuit 23 to the calculating section 24*a*' is referred by a reference numeral 23*a*, and the color reference number of the second layer data 5*b* is referred by a reference numeral 23*b*.

The calculating section 24*a*' contains a comparator 24*d*, a conversion/operation unit 24*e*, and a flip-flop 24*f*. The comparator 24*d* compares the color reference number 23*b* of the second layer data 5*b* with the color reference number 23*a* from the color palette circuit 23 to generate a comparison result data 30*b* of 2 bits. One bit of the comparison result data 30*b* indicates whether or not the color reference number 23*b* of the second layer data 5*b* is "0". The other bit indicates whether or not the color reference number 23*b* of the second layer data 5*b* is coincident with the color reference number 23*a* from the color palette circuit 23. The conversion/operation unit 24*e* carries out the calculation on the RGB data of each pixel of the first layer data 5*a* and the RGB data 23*a* from the color palette circuit 23 corresponding to the comparison result data 30*b*, or outputs the output from the flip-flop 24*f* as it is. The flip-flop 24*f* latches the calculation result by the conversion/operation unit 24*e* in response to the write signal 28 sent by the control circuit 21. Furthermore, the flip-flop 24*f* outputs the latched calculation result to the conversion/operation unit 24*e* and the driving circuit 25 as the synthetic RGB data 30*a*.

An operation of the conversion/operation unit 24*e* will be described in detail below. As shown in FIGS. 6A to 6F by the first cycle, the operation of the conversion/operation unit 2 is switched based on the comparison result data 30*b*. When the comparison result data 30*b* indicates that the color reference number 23*b* of the second layer data 5*b* is "0", the conversion/operation unit 24*e* outputs the RGB data of the first layer data 5*a* as the calculation result. Then, the color of the corresponding pixel of the second layer data 5*b* is reflected on the calculation result as a "transparency". On contrary, when the comparison result data 30*b* indicates that the color reference number 23*b* of the second layer data 5*b* is not "0", the calculation of the conversion/operation unit 24*e* depends on whether or not the color reference number 23*b* of the second layer data 5*b* is coincident with the color reference number 23*a* from the color palette circuit 23. When the comparison result data 30*b* indicates the coincidence of the color reference number 23*a* and the color reference number 23*b*, the conversion/operation unit 24*e* carries out the calculation of the RGB data of the first layer data 5*a* and the RGB data 23*a* from the color palette circuit 23 to output the calculation result to the flip-flop 24*f*. Otherwise, the conversion/operation unit 24*e* outputs the synthetic RGB data 30*a* from the flip-flop 24*f*, as it is as the calculation result.

When the color reference numbers 23*a* outputted from the color palette circuit 23 is cycled once, the desired RGB data 30*a* is outputted from the flip-flop 24*f*. That is, the RGB data 30*a* obtained by synthesizing the pixels of the first layer image and the second layer image is generated. FIGS. 6A to 6F show a generation process of the desired synthetic RGB data 30*a* from the flip-flop 24*f*. The color reference number 23*a* outputted from the color palette circuit 23 is sequentially increased from "0". In addition, the color palette circuit 23 sequentially outputs the RGB data 23*b* corresponding to the color reference number 23*b* in synchronism with the increase of the color reference number 23*b*. When the color reference number 23*a* from the color palette circuit 23 is coincident with the color reference number 23*b* of the second layer data 5*b*, the output of the flip-flop 24*f* is switched into the calculation result of the RGB data 23*a* corresponding to the color reference number 23*b* and the RGB data of the first layer data 5*a* (see the first cycle). When the color reference number of the second layer data 5*b* is "0", the output of the flip-flop 24*f* is switched instantly to the RGB data of the first layer data 5*a* (see the second cycle) Anyway, in either case, in the end of the cycle of the RGB data 23*a* and the color reference number 23*b*, the desired synthetic RGB data 30 can be generated on the output of the flip-flop 24*f*. The calculating section 24*a*' shown in FIG. 5 is preferable to decrease the number of wirings to connect the calculating section 24*a*' with the color palette circuit 23.

Second Embodiment

Figure 7:
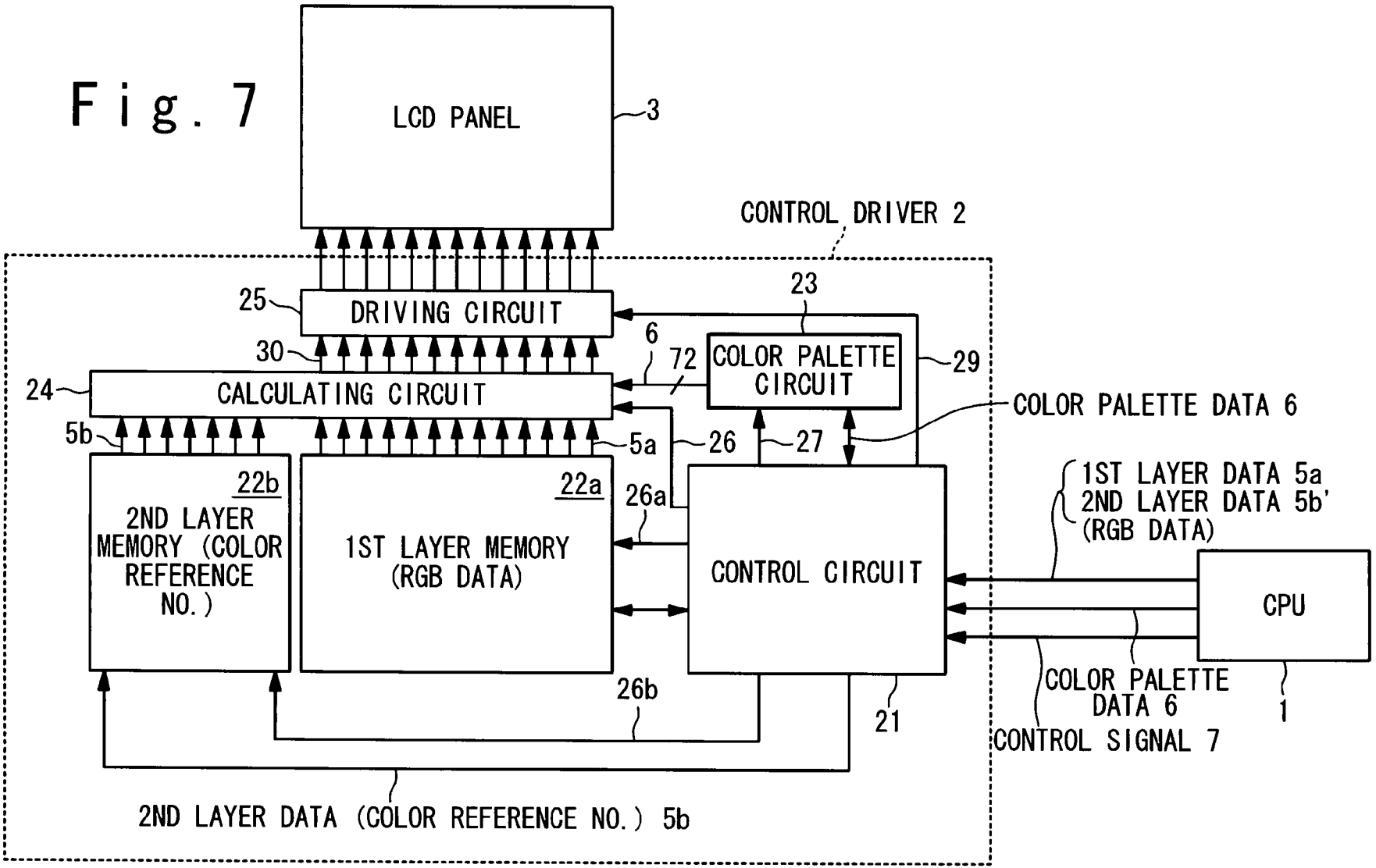
FIG. 7 is a block diagram showing the circuit configuration of the controller driver in the mobile terminal according to a second embodiment of the present invention.

FIG. 7 is a block diagram showing the circuit configuration of the controller driver 2 according to the second embodiment of the present invention. In the second embodiment, the second layer image sent from the CPU 1 to the controller driver 2 is not described in a color reference number, but in a usual bit map format. In other words, the second layer data 5*b*' for the second layer image is described as the RGB data to be sent to the controller driver 2. The control circuit 21 converts the sent second layer data 5*b*' into the second layer data 5*b* described in the format of the color reference number to store it in the second layer memory 22*b*. Receiving the second layer data 5*b*' in the RGB data format, the control circuit 21 converts the received second layer data 5*b*' to the second layer data 5*b* in the format of the color reference number referring to the color palette data 6 stored in the color palette circuit 23. The configuration of the controller driver 2 in the second embodiment is same as that in the first embodiment other than that the second layer data 5*b*' in the RGB data format is supplied to the controller driver 2. It should be noted that the calculating circuit 24 in the second embodiment may have the configuration shown in FIG. 3 or FIG. 5.

Figure 8:
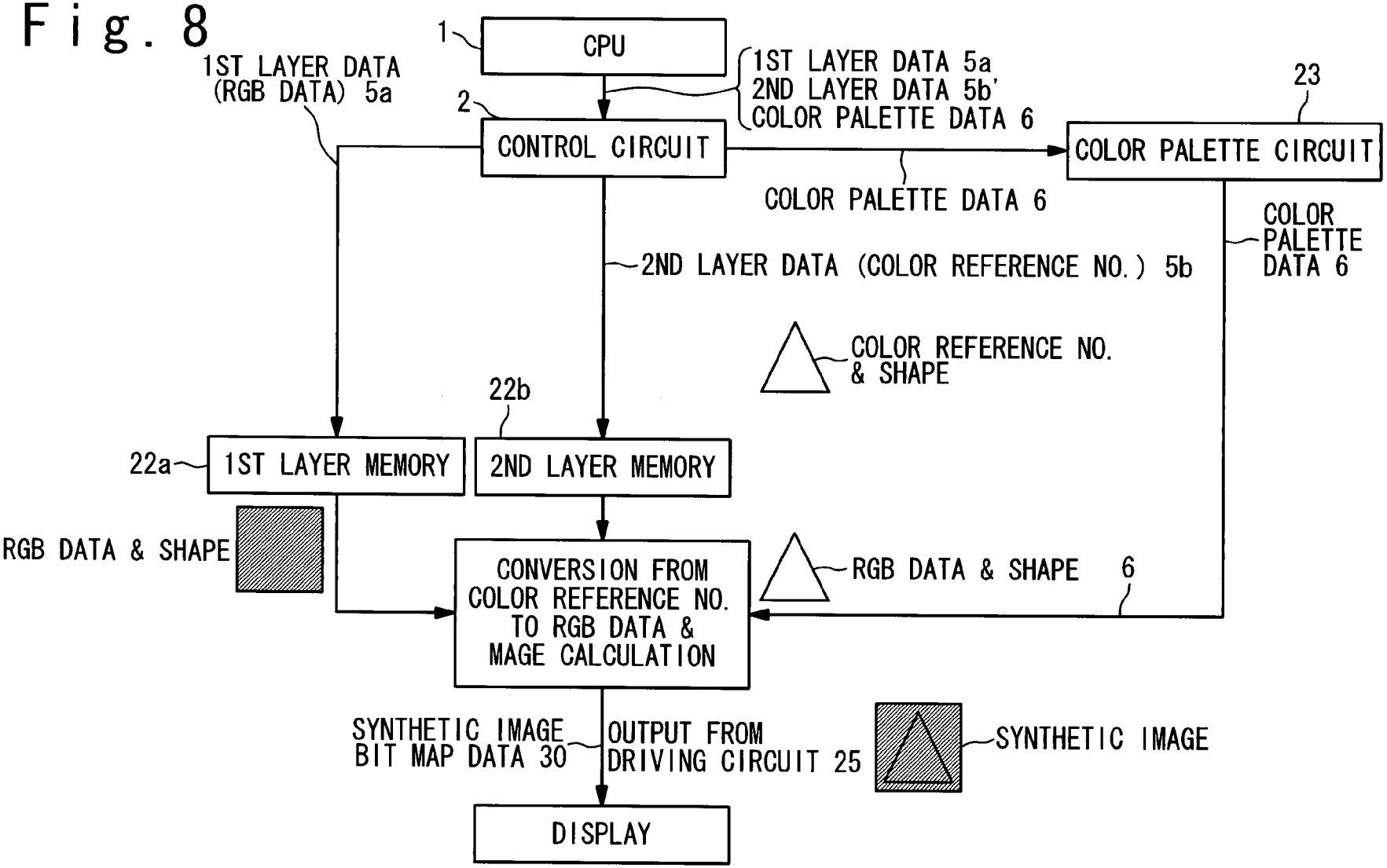
FIG. 8 is a flow chart showing an operation of the controller driver in the second embodiment.

FIG. 8 is a flow chart showing an operation of the controller driver 2 in the second embodiment. First, the first layer data 5*a* is supplied from the CPU 1 to the controller driver 2. As described above, the first layer data 5*a* is composed of the RGB data specifying the colors of the pixels of the first layer image. The first layer data 5*a* is stored in the first layer memory 22*a*.

Subsequently, the color palette data 6 is supplied from the CPU 1 to the controller driver 2. The color palette data 6 is stored in the color palette circuit 23.

In addition, the second layer data 5*b*' is supplied from the CPU 1 to the controller driver 2. The second layer data 5*b*' is composed of the RGB data specifying the colors of the pixels of the second layer image like the first layer data 5*a*. The control circuit 21 in the controller driver 2 converts the RGB data of the second layer data 5*b*' into the color reference numbers by referring to the color palette data 6 stored in the color palette circuit 23 in order to generate the second layer data 5*b* in the format of the color reference number. The second layer data 5*b* is stored in the second layer memory 22*b*.

The calculating circuit 24 reads out the first layer data 5*a* and the second layer data 5*b* from the first layer memory 22*a* and the second layer memory 22*b*, respectively. The calculating circuit 24 converts the color reference numbers of the second layer data 5*b* into the RGB data, and carries out the calculation on the generated RGB data through the conversion and the RGB data of the first layer data 5*a*. Then, the synthetic image bit map data 30 is generated.

The driving circuit 25 drives the LCD panel 3 based on the synthetic image bit map data 30. As a result, the synthetic image obtained by synthesizing the first layer image and the second layer image is displayed on the LCD panel 3.

As mentioned above, in the second embodiment, the second layer data 5*b* stored in the second layer memory 22*b* is described in the format of the color reference number, like the first embodiment. Therefore, the capacity of the second layer memory 22*b* can be decreased. As a result, the controller driver 2 can realize the calculation for plurality of images while the capacity of the installed memory is reduced. The reduction in the capacity of the installed memory is effective for reduction of power consumption and a spatial size of the controller driver 2.

Third Embodiment

Figure 9:
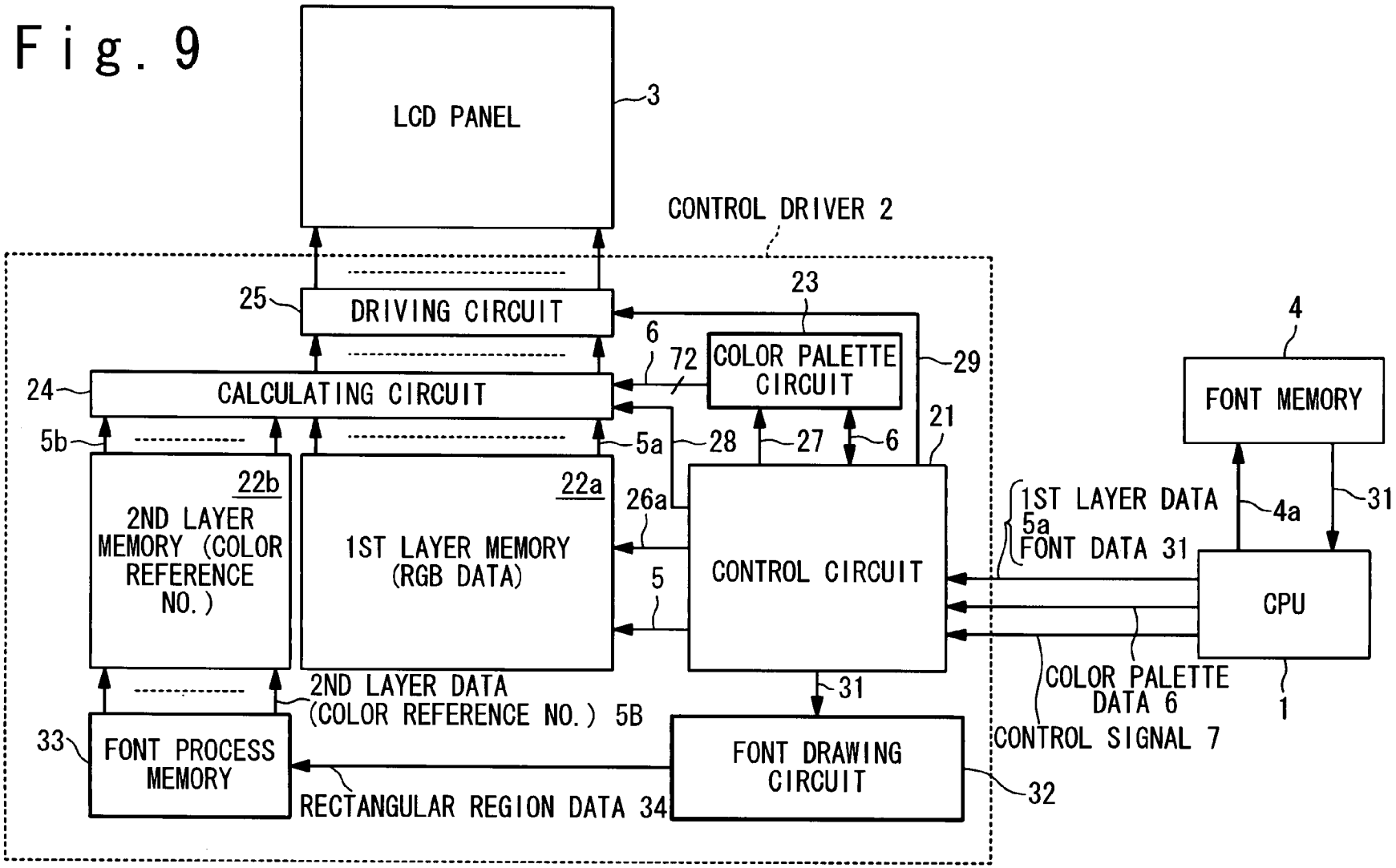
FIG. 9 is a block diagram showing the configuration of the controller driver in the mobile terminal according to a third embodiment of the present invention.

FIG. 9 is a block diagram showing a configuration of a mobile terminal provided with a controller driver according to the third embodiment of the present invention. The circuit configuration of controller driver 2 is similar to those of the first and second embodiments as a whole. However, in the controller driver 2 in the third embodiment, a component of the second layer image is specialized to characters. In addition, the controller driver 2 in the third embodiment is modified in its configuration and operation to reduce the power consumption.

First, one of the features of the controller driver 2 in the third embodiment is in that font data 31 corresponding to the character image to be superimposed on the first layer image is send to the controller driver 2 in place of the second layer data 5*b*. The font data 31 is data indicative of a shape and color of the character image to be displayed, and is described in the font format which is different from the bit map font format. Most preferably, the font data 31 is described in a stroke font format. The data quantity of the font data described in the stroke font format is smaller than that of the font data described in the bit map format in many cases. Therefore, using the stroke font format is preferred to reduce the data quantity of the font data 31.

The font data 31 includes a color of the character image to be displayed and a command that specifies the shape of the component of the character image. When the stroke font format is used to describe the font data 31, the commands included in the font data 31 most typically have a coordinates of the control point of the character image to be displayed, a description of the kind of a line to connects the control points, and a description of the color of the character image. The font data 31 can be described in another outline font format. In this case, the font data 31 includes a borderline of the character image and a command specifying the color to be painted in the borderline.

Sending the character image as the second layer image by using the font data 31 is advantageous for reduction of power consumption of the controller driver 2. The data quantity of the display data sent to the controller driver 2 can be decreased by using the font data 31. The controller driver 2 consumes some power whenever each data bit of the display data is received. Therefore, the reduction of the data quantity of the display data sent to the controller driver 2 contributes to reduction of the power consumption of the controller driver 2 effectively.

In accordance with the modification that the font data 31 is sent to the controller driver 2 in the third embodiment, the CPU 1 is connected with the font memory 4, and the controller driver 2 includes a font drawing circuit 32 and a font process memory 33.

The font memory 4 is used for the CPU 1 to generate the font data 31. The font memory 4 stores font data of all possible character images to be displayed. To display a character image in an on-screen display, the CPU 1 calculates an address 4*a* of the font memory 4, in which the font data for the character image is stored, based on a character-code of the character. The CPU 1 acquires the font data 31 of the character image to be displayed by accessing the font memory 4 based on the address 4*a*.

The font drawing circuit 32 and the font process memory 33 is used to generate the second layer data 5*b* corresponding to the second layer image based on the font data 31. It should be noted that the second layer image is for characters, and is described in the format of the color reference number, as mentioned above. A font drawing circuit 32 sequentially interprets the commands included in the font data 31, and sequentially generates pixel data of the pixels corresponding to each of components of the character specified by the command in the font process memory 33. This operation will be described as "drawing of characters" in the following description. When the "drawing of characters" of the second layer image is completed for one frame, the complete second layer data 5*b* is generated in the font process memory 33. The second layer data 5*b* is transmitted to the second layer memory 22*b* after the completion of the "drawing of characters". As mentioned above, the description of the second layer data 5 in the format of the color reference number contributes to the decrease in the capacity of the second layer memory 22*b*. In addition, it should be noted that this also contributes to the decrease in the capacity of the font process memory 33.

The reason why the font process memory 33 is provided separately from the second layer memory 22*b* is in prevention of display of an imperfect character image on the LCD panel 3. As mentioned above, "drawing of characters" is executed by sequentially interpreting the commands included in the font data 33. Therefore, the second layer data 5*b* is not complete until the "drawing of characters" is completed. A necessary time for the "drawing of characters" cannot be neglected, compared with the time of a refresh cycle of the LCD panel 3. Therefore, if the second layer data 5*b* is directly written in the second layer memory 22*b*, there is a case that the bit map data of the components of the characters are read before the second layer data 5*b* of the character image to be displayed is completed, so that the LCD panel 3 is driven based on the read bit map data. This means that an imperfect character is displayed on the LCD panel 1. The font process memory 33 functions to prevent such a problem. After the "drawing of characters" is completed and then the complete second layer data 5*b* is generated in the font process memory 33, the second layer data 5*b* is sent to the second layer memory 22*b*. Here, the data transfer between the memories can be carried out in a shorter time than the "drawing of characters". The calculating circuit 24 and the driving circuit 25 carry out the on-screen display by using the complete second layer data 5*b* stored in the second layer memory 22*b*. As a result, it is possible to prevent the imperfect character from displaying on the LCD panel 3.

The data write operation in the font process memory 33 is sequentially carried out. Therefore, it is desirable that the data is written in the font process memory 33 at high speed. In the third embodiment, to achieve the high-speed write operation in the font process memory 33, a fact that the characters are usually drawn in a single color is effectively utilized. In the write operation of the pixel data of the character image in the font process memory 33, the pixel data of pixels for a plurality of rows and columns are written in at a same time.

In order to write the pixel data of pixels for the plurality of rows and columns in at the same time, both of the font drawing circuit 22 and font process memory 23*c* carry out the following operations. The font drawing circuit 32 grasps a shape of the character image to be displayed based on the font data 31, and separates the character image into rectangular areas to produce rectangular area data 34 for each rectangular area. Then, the font drawing circuit 32 sends the rectangular area data 34 to the font process memory 33. Each of the rectangular area data 34 contains an x-coordinate "$x_0$" and a y-coordinate "$y_0$" of the center of the rectangular area, a width "W" of a horizontal direction (x direction) and a height "h" of a vertical direction (y direction), and a color reference number to designate a color of the pixels contained in the rectangular area. The font process memory 33 simultaneously writes the color reference numbers of all the pixels contained in the rectangular area into memory cells based on the rectangular area data 34. The configuration allows the pixel data of the second layer image, i.e., the second layer data 5*b* to be written in the font process memory 33 in a high speed.

Figure 10A:
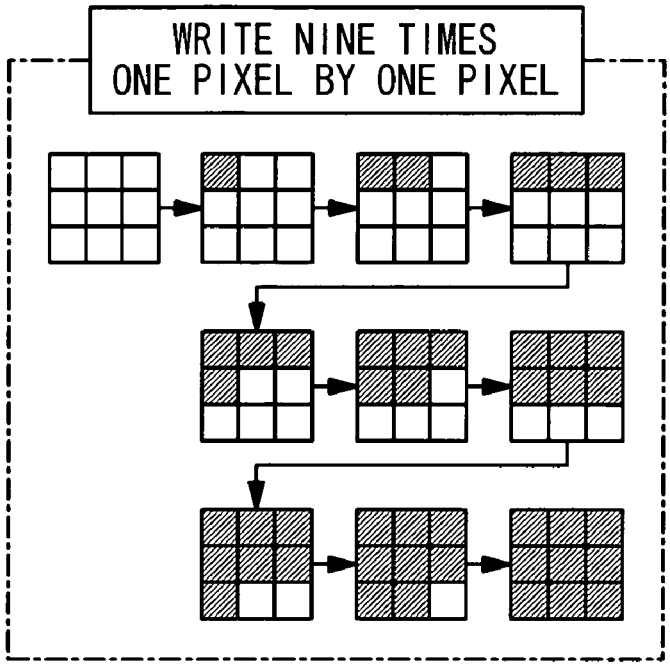
FIGS. 10A and 10B are diagrams showing examples in which color reference numbers of pixels are written.
Figure 10B:
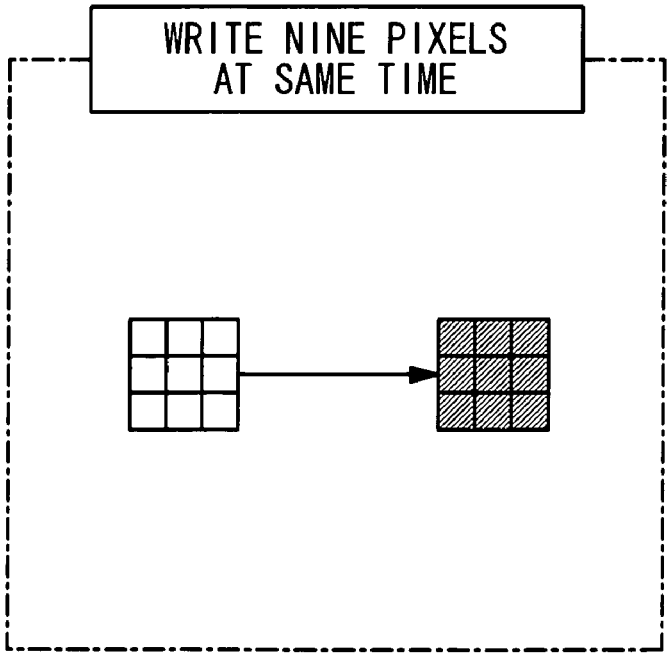

FIGS. 10A and 10B show examples in which the color reference numbers of pixels are written. The pixels are arranged within the rectangular area in a plurality of rows and a plurality of columns. As shown in FIG. 10A, the writing operation of the pixel data is carried out for every pixel in the most typical conventional frame memory. The writing operation of the pixel data is sequentially carried out nine times in a matrix of 3 rows×3 columns. On the other hand, in the fifth embodiment, the pixel data in the matrix of a plurality of rows and columns are simultaneously written in the memory cells of the font process memory 33. This allows the write operation of the second layer data 5*b* into the font process memory 33 in a high speed.

Figure 11:
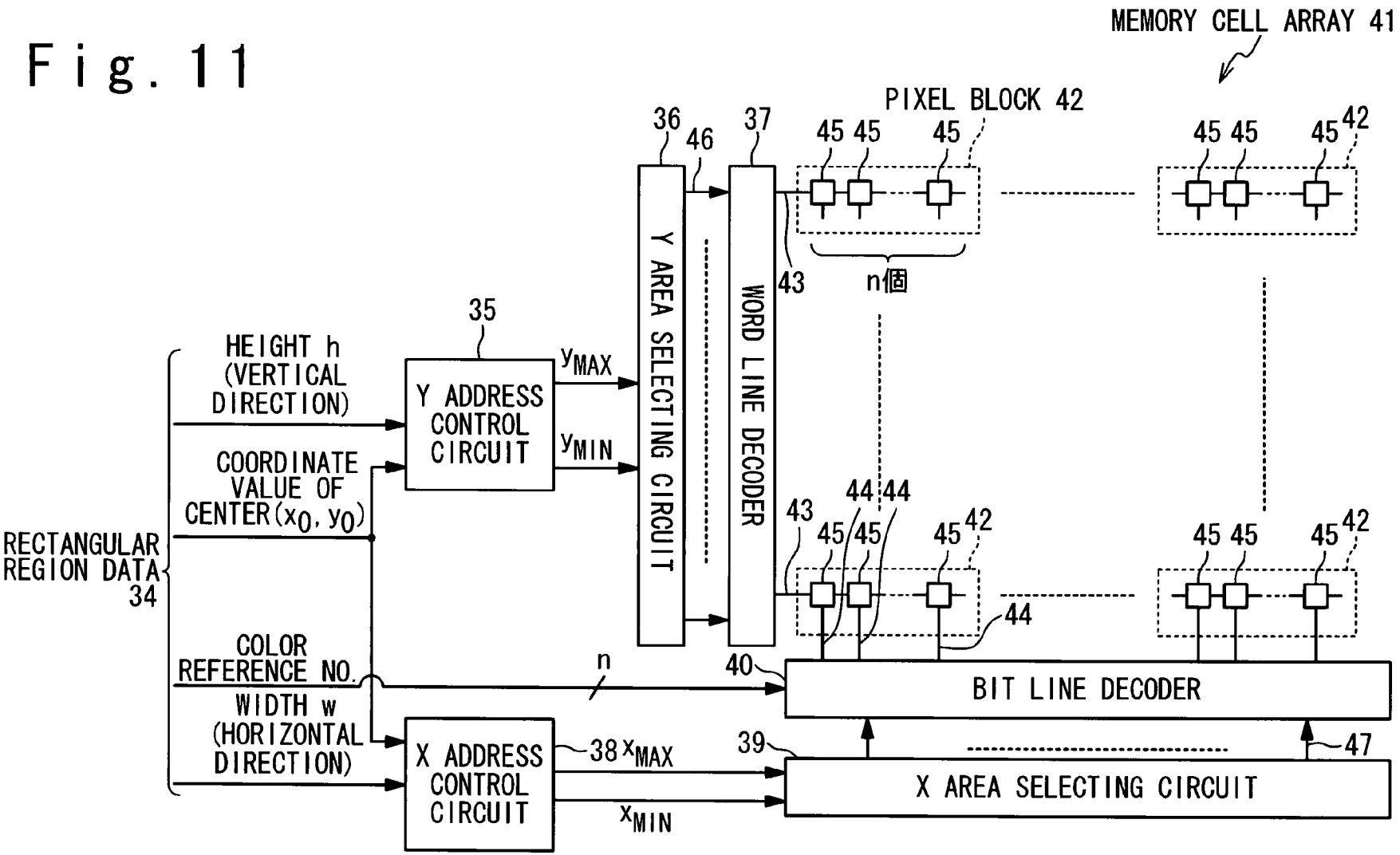
FIG. 11 is a block diagram showing the hardware configuration of a font process memory.
Figure 12:
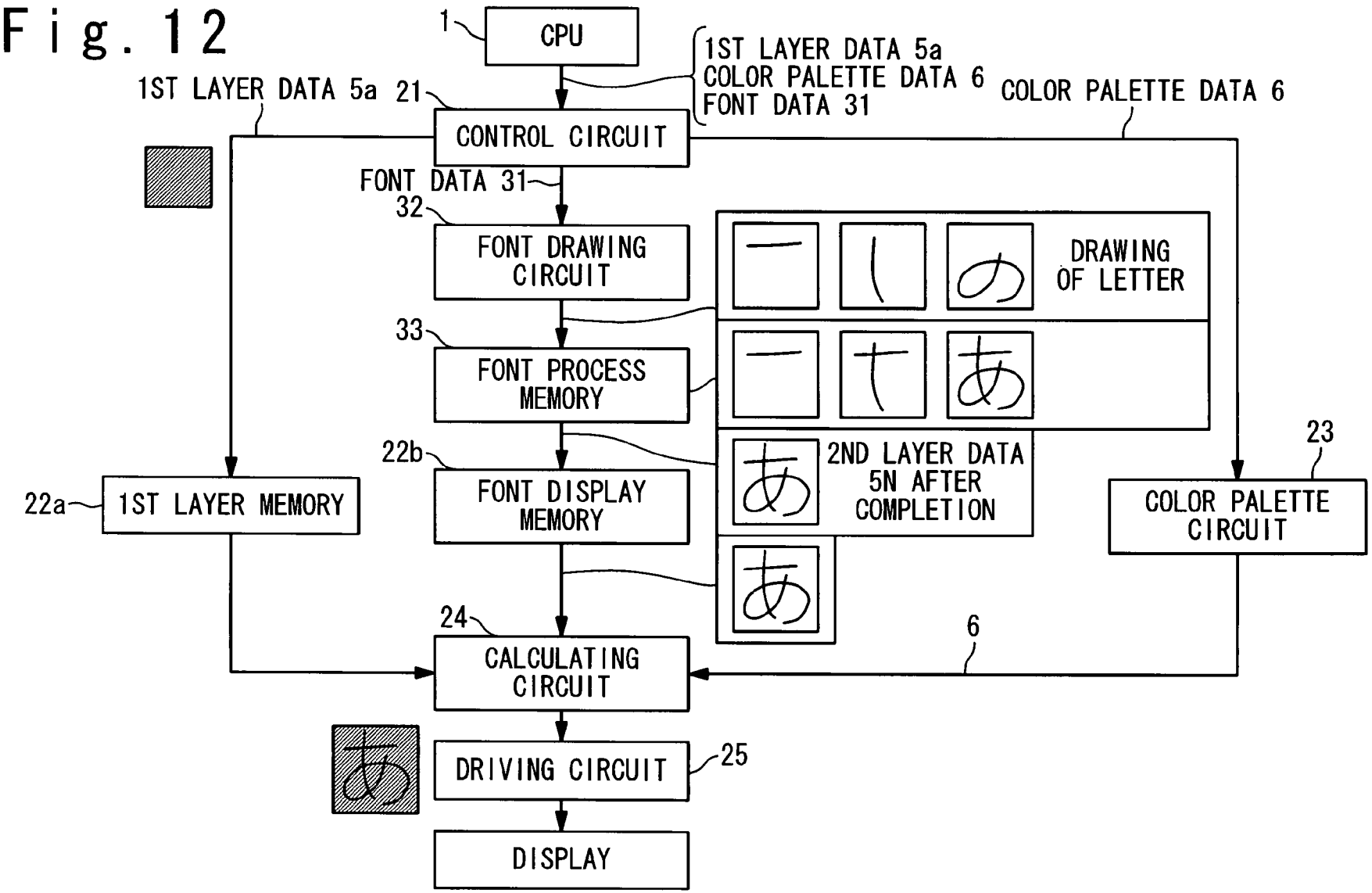
FIG. 12 is a flow chart showing an operation of the controller driver in the third embodiment.

FIG. 11 is a block diagram showing the hardware configuration of the font process memory 33. The font process memory 33 is composed of a Y-address control circuit 35, a Y-area selecting circuit 36, a word line decoder 37, an X-address control circuit 38, an X-area selecting circuit 39, a bit line decoder 40, and a memory cell array 41. The memory cell array 41 is provided with pixel blocks 42 arranged in a matrix form, word lines 43, and bit lines 44. The pixel block 42 is addressed based on an x-address and a y-address. The pixel block 42 is provided with n memory cells 45 in the horizontal direction. Pixel data for one pixel (namely, color reference number) is stored into one pixel block 42. It should be understood that the pixel data is composed of an n-bit color reference number. The memory cells 45 are positioned at locations where the word lines 43 are intersected to the bit lines 44.

The Y-address control circuit 35 calculates a maximum value "$y_{MAX}$" of the y-address and a minimum value "$y_{MIN}$" of the y-address for the rectangular area indicated in the rectangular area data 34 based upon the y coordinate "$y_0$" of the rectangular area and the height "h" of the rectangular area. The calculation method of the maximum value $y_{MAX}$ and the minimum value $y_{MIN}$ are different, depending upon whether the height "h" is an odd number or an even number. When the height "h" is the odd number, the maximum and minimum values $y_{MAX}/y_{MIN}$ are calculated from the following equations:

$$y_{MAX}=y_0+h/2, \text{ and}$$

$$y_{MIN}=y_0-h/2.$$

When the height "h" is the even number, the maximum and minimum values $y_{MAX}/y_{MIN}$ are calculated from the following equations:

$$y_{MAX}=y_0+h/2, \text{ and}$$

$$y_{MIN}=y_0-h/2-1.$$

The Y-area selecting circuit 36 outputs y-address signals 46 to the word line decoder 37 based on the maximum value $y_{MAX}$ and the minimum value $y_{MIN}$ of the y-address of the rectangular area. Each y-address signal 46 indicates whether or not a corresponding y-address is selected. When the number of the pixel blocks 42 arranged in a column direction is "M", namely, when the y-address has a value equal to or larger than "0", and equal to or smaller than "M−1", "M" y-address signals 46 are outputted to the word line decoder 37. The Y-area selecting circuit 36 activates the y-address signals 46 to be selected, i.e., the y-addresses $y_{MIN}$ to $y_{MAX}$ It should also be understood that the plurality of y-addresses can be selected in the writing operation.

The word line decoder 37 activates the word line 44 in response to the y-address signals 46. When the plurality of y-addresses are selected, the plurality of word lines are made active at a same time. When the word line 43 is activated, the memory cells 45 connected to the activated word lines 43 are connected to the bit lines 44.

Similar to the Y-address control circuit 35, the X-address control circuit 38 calculates a maximum value "$x_{MAX}$" of an x-address and a minimum value "$x_{MIN}$" of the x-address in the rectangular area indicted in the rectangular area data 34 based on the x coordinate "$x_0$" and width "W" of the rectangular area. The calculation method of the maximum value $x_{MAX}$ and the minimum value $x_{MIN}$ are different depending upon whether the width "W" is an odd number or an even number. When the width "W" corresponds to the odd number, the maximum and minimum values $x_{MAX}/x_{MIN}$ are calculated from the following equations:

$$x_{MAX}=x_0+w/2, \text{ and}$$

$$x_{MIN}=x_0-w/2.$$

When the width W is the even number, the maximum and minimum values $x_{MAX}/x_{MIN}$ are calculated from the following equations:

$$x_{MAX}=x_0+w/2, \text{ and}$$

$$x_{MIN}=x_0+w/2-1$$

The X-area selecting circuit 39 outputs x-address signals 47 to the bit line decoder 40 in response to the maximum value $x_{MAX}$ and the minimum value $x_{MIN}$ of the x-addresses of the rectangular area. Each x-address signal 47 indicates whether or not a corresponding x-address is selected. When the number of the pixel blocks 42 arranged in the row direction is "N", namely, when x-address is equal to or larger than "0", and equal to or smaller than "N−1", "N" x-address signals 47 are outputted to the bit line decoder 40. The X-area selecting circuit 39 activates the x address signals 47 to be selected, i.e., x address signals $x_{MIN}$ to $x_{MAX}$. It should be understood that the plurality of x addresses can be selected in the writing operation. Thus, the pixel blocks 42 are selected based on both of the y-addresses selected by the Y-area selecting circuit 36 and the x-addresses selected by the X-area selecting circuit 39.

The bit line decoder 40 connects the bit lines 44 corresponding to the selected x-addresses to "n" signal lines based on the x-address signals 47 such that the color reference numbers are transferred to the font process memory 33. As a result, the color reference signals are written into the selected pixel block 42. In other words, the data bits corresponding to the color reference number are written in the memory cells 45 of the selected pixel block 42.

Such configuration of the font process memory 33 allows the pixel block 42 of the plurality of rows and columns to be selected and the color reference numbers to be written in the selected pixel blocks 42 at a same time.

FIG. 11 is a block diagram showing an operation of the controller driver 2 according to the fifth embodiment when the on-screen display is carried out. When the first layer data 5*a* of the first layer image and the font data 31 of the character image to be superimposed on the first layer image are sent from the CPU 1 to the control circuit 21, the control circuit 21 sends the first layer data 5*a* to the first layer memory 22*a* and the font data 31 to the font drawing circuit 32. The first layer data 5*a* is written in the first layer memory 22*a*. When the color palette data 6 is sent from the CPU 1, the control circuit 21 writes the color palette data 6 into the color palette circuit 23.

The font drawing circuit 32 sequentially interprets commands contained in the font data 31, and grasps the shape of the character image to be displayed, and separates the character image into rectangular areas. Further, the font drawing circuit 32 sequentially sends the rectangular area data 34 to the font process memory 33 for "drawing of character". It should be noted that color reference numbers of a plurality of pixels contained in a certain rectangular area are written in the font process memory 33 at a same time.

After the second layer data 5*b* is completed in the font process memory 33, the second layer data 5*b* is transferred to the second layer memory 22*b*. The transfer operation of the second layer data 5*b* to the second layer memory 22*b* is carried out within a short time, as compared with the refresh cycle of the LCD panel 1.

The calculating circuit 24 reads the first layer data 5 from the first layer memory 22*a* and the second layer data 5*b* from the second layer memory 22*b*. Then, the calculating circuit 24 produces the synthetic bit map data 30. The calculating circuit 24 converts the color reference numbers of the second layer data 5*b* into RGB data, and calculates the converted RGB data with the RGB data of the first layer data 5*a* to produce the synthetic bit map data 30. The driving circuit 25 drives the LCD panel 1 based on the synthetic bit map data 30 sent from the calculating circuit 24, so that the on-screen display of the character image can be achieved.

In the third embodiment, the second layer data 5*b* stored in the second layer memory 22*b* (and in the font process memory 33) is described in the format of the color reference number, as well as the first and second embodiments. Therefore, the capacity of the second layer memory 22*b* (and, the capacity of the font process memory 33) can be decreased.

In addition, in the third embodiment, the data quantity of the character image to be sent from the CPU 1 to the controller driver 2 and to be superimposed on the background image by using the font data 31 can be reduced. As a result, the power consumption of the controller driver 2 and EMI can be reduced.

Furthermore, in the third embodiment, the font drawing circuit 32 and the font process memory 33 can write the pixel data of the pixels arranged in plural rows and columns at a same time. As a result, the data processing speed to display the character image can be carried out at high speed.

What is claimed is:

1. A controller driver comprising:

a color palette circuit configured to hold color palette data indicating a relation of a color reference number corresponding to a color and RGB data corresponding to the color;

a first memory section configured to hold first layer data containing first RGB data specifying a color of each of pixels of a first layer image;

a second memory section configured to hold second layer data containing a color reference number specifying a color of each of pixels of a second layer image;

a calculating circuit configured to generate synthetic image data of said first layer data and said second layer data; and a driving circuit configured to drive a display panel based on said synthetic image data, wherein said calculating circuit converts each of color reference numbers of said second layer data into second RGB data by using said color palette data, and generates synthetic RGB data from said first RGB data and said second RGB data, said synthetic RGB data specifying a color of each of pixels of said synthetic image data, and wherein said controller driver is installed in a mobile device and power of said controller driver is reduced due to display data reduction.

2. The controller driver according to claim 1, wherein said color palette data contains a transparent color reference number corresponding to a transparent color, and wherein when said color reference number of a specific one of the pixels of said second layer image is said transparent color reference number, said calculating circuit outputs said first RGB data corresponding to the specific pixel as said synthetic RGB data corresponding to the specific pixel.

3. The controller driver according to claim 2, further comprising:

a control circuit configured to receive said color palette data from outside and to write said color palette data into said color palette circuit.

4. The controller driver according to claim 1, further comprising:

a control circuit configured to receive said second layer data from outside and to write said second layer data into said second memory section.

5. The controller driver according to claim 1, further comprising:

a control circuit configured to receive RGB image data comprising third RGB data to specify the color of each of the pixels of said second layer image, to convert said RGB image data into said second layer data, and to write said second layer data in said second memory section.

6. The controller driver according to claim 1, wherein said color palette circuit outputs a set of said RGB data and said color reference number corresponding to a color to said calculating circuit for every said color reference number corresponding to a color, and wherein when said color reference number contained in said second layer data is coincident with said color reference number received from said color palette circuit, said calculating circuit determines said synthetic RGB data corresponding to said color reference number received from said color palette circuit as said second RGB data.

7. The controller driver according to claim 1, wherein said second layer image comprises a character image for characters, and wherein said controller driver further comprises:

a font drawing circuit configured to receive font data supplied from outside and showing a shape and a color of each of the characters, and to generate said second layer data from said font data.

8. The controller driver according to claim 7, further comprising:

a font process memory section used as a work area when said font drawing circuit generates said second layer data, wherein said font drawing circuit generates said second layer data in said font process memory section from said font data, and wherein said second layer data is transferred to said second memory section from said font process memory section.

9. The controller driver according to claim 8, wherein said font drawing circuit divides said character image into rectangular areas and generates rectangular area data specifying a color of pixels in each of said rectangle areas by a color reference number, and wherein said font process memory section is configured such that pixel data specifying the color of the pixels of a plurality of rows and columns in each of said rectangle areas can be written at a time based on said rectangle area data.

10. The controller driver according to claim 1, wherein RGB data corresponding to all of color reference numbers are sent in parallel to the calculating section, wherein the color palette circuit sequentially sends the RGB data of the color palette data for all the color reference numbers, and wherein the color reference number is sent to the calculating section.

11. A mobile terminal comprising:

a display panel;

a controller driver; and a processing unit configured to supply to said controller driver, first layer data comprising first RGB data specifying each of colors of pixels of a first layer image and second layer data comprising a color reference number specifying each of colors of pixels of a second layer image, wherein said controller driver comprises:

a color palette circuit configured to hold color palette data indicating a relation of a color reference number corresponding to a color and RGB data corresponding to the color;

a first memory section configured to hold said first layer data;

a second memory section configured to hold second layer data;

a calculating circuit configured to generate synthetic image data of said first layer data and said second layer data; and a driving circuit configured to drive a display panel based on said synthetic image data, wherein said calculating circuit converts each of color reference numbers of said second layer data into second RGB data by using said color palette data, and generates synthetic RGB data from said first RGB data and said second RGB data, said synthetic RGB data specifying a color of each of pixels of said synthetic image data, and wherein said controller driver is installed in the mobile terminal and power of said controller driver is reduced due to display data reduction.

12. The mobile terminal according to claim 11, wherein said color palette data contains a transparent color reference number corresponding to a transparent color, and wherein when said color reference number of a specific one of the pixels of said second layer image is said transparent color reference number, said calculating circuit outputs said first RGB data corresponding to the specific pixel as said synthetic RGB data corresponding to the specific pixel.

13. The mobile terminal according to claim 12, further comprising:

a control circuit configured to receive said color palette data from outside and to write said color palette data into said color palette circuit.

14. The mobile terminal according to claim 11, further comprising:

a control circuit configured to receive said second layer data from outside and to write said second layer data into said second memory section.

15. The mobile terminal according to claim 11, further comprising:

a control circuit configured to receive RGB image data comprising third RGB data to specify the color of each of the pixels of said second layer image, to convert said RGB image data into said second layer data, and to write said second layer data in said second memory section.

16. The mobile terminal according to claim 11, wherein said color palette circuit outputs a set of said RGB data and said color reference number corresponding to a color to said calculating circuit for every said color reference number corresponding to a color, and wherein when said color reference number contained in said second layer data is coincident with said color reference number received from said color palette circuit, said calculating circuit determines said synthetic RGB data corresponding to said color reference number received from said color palette circuit as said second RGB data.

17. The mobile terminal according to claim 11, wherein said second layer image comprises a character image for characters, and wherein said controller driver further comprises:

a font drawing circuit configured to receive font data supplied from outside and showing a shape and a color of each of the characters, and to generate said second layer data from said font data.

18. The mobile terminal according to claim 17, further comprising:

a font process memory section used as a work area when said font drawing circuit generates said second layer data, wherein said font drawing circuit generates said second layer data in said font process memory section from said font data, and wherein said second layer data is transferred to said second memory section from said font process memory section.

19. The mobile terminal according to claim 18, wherein said font drawing circuit divides said character image into rectangular areas and generates rectangular area data specifying a color of pixels in each of said rectangle areas by a color reference number, and wherein said font process memory section is configured such that pixel data specifying the color of the pixels of a plurality of rows and columns in each of said rectangle areas can be written at a time based on said rectangle area data.

20. A display panel driving method comprising:

providing for a controller driver, color palette data indicating a relation of color reference numbers corresponding to colors and RGB data corresponding to the colors;

holding in said controller driver, first layer data comprising first RGB data specifying a color of each of pixels of a first layer image;

holding in said controller driver, second layer data comprising a color reference number specifying a color of each of pixels of a second layer image;

synthesizing said first layer data and said second layer data by a calculating circuit to generate synthetic image data; and driving a display panel based on said synthetic image data by said controller driver, wherein said synthesizing comprises:

converting color reference numbers for each of the pixels of said second layer image into second RGB data by using said color palette data; and generating RGB data of said synthetic image data by using said first RGB data and said second RGB data, wherein said controller driver is installed in a mobile device and power of said controller driver is reduced due to display data reduction.

* * * * *